US009820076B2

(12) United States Patent
Guo et al.

(10) Patent No.: US 9,820,076 B2
(45) Date of Patent: Nov. 14, 2017

(54) INFORMATION PROCESSING METHOD AND ELECTRONIC DEVICE

(71) Applicants: Beijing Lenovo Software Ltd., Beijing (CN); Lenovo (Beijing) Limited, Beijing (CN)

(72) Inventors: Ping Guo, Beijing (CN); Weiyu Yang, Beijing (CN); Gang Yan, Beijing (CN)

(73) Assignees: Beijing Lenovo Software Ltd., Beijing (CN); Lenovo (Beijing) Limited, Beijing (CN)

( * ) Notice: Subject to any disclaimer, the term of this patent is extended or adjusted under 35 U.S.C. 154(b) by 102 days.

(21) Appl. No.: 14/932,239

(22) Filed: Nov. 4, 2015

(65) Prior Publication Data

US 2016/0381484 A1 Dec. 29, 2016

(30) Foreign Application Priority Data

Jun. 29, 2015 (CN) ..... 2015 1 0370106

(51) Int. Cl.
*H04H 20/47* (2008.01)
*H04S 7/00* (2006.01)
(Continued)

(52) U.S. Cl.
CPC ..... *H04S 7/302* (2013.01); *H04R 1/028* (2013.01); *H04S 1/00* (2013.01); *H04S 7/305* (2013.01)

(58) Field of Classification Search
CPC .... H04R 2217/03; H04R 1/403; H04R 23/00; H04R 1/028; H04R 3/12; H04R 17/00;
(Continued)

(56) References Cited

U.S. PATENT DOCUMENTS 5,638,824 A * 6/1997 Summers ..... A61B 5/113 600/437
6,243,323 B1 * 6/2001 Li ..... G01S 15/102 367/138

(Continued)

FOREIGN PATENT DOCUMENTS

CN 1922916 A 2/2007
CN 101010981 A 8/2007

(Continued)

OTHER PUBLICATIONS

"Chinese Application No. 201510370106.5, Office Action dated Aug. 29, 2017", w/ English Translation, (Aug. 29, 2017), 25 pgs.

*Primary Examiner* — Akelaw Teshale
(74) *Attorney, Agent, or Firm* — Schwegman Lundberg & Woessner, P.A.

(57) ABSTRACT

Embodiments of the present disclosure provide an information processing method and an electronic device. The method comprises: modulating a first audio signal associated with a first channel in a first sound source file onto a first ultrasound signal to obtain a first modulated ultrasound signal; modulating a second audio signal associated with a second channel in a second sound source file onto a second ultrasound signal to obtain a second modulated ultrasound signal; transmitting a first ultrasound wave associated with the first modulated ultrasound signal, such that the first ultrasound wave, once reflected by a first reflection plane, produces a first audible sound signal corresponding to the first audio signal; and transmitting a second ultrasound wave associated with the second modulated ultrasound signal, such that the second ultrasound wave, once reflected by a second reflection plane, produces a second audible sound signal corresponding to the second audio signal.

9 Claims, 6 Drawing Sheets

(51) Int. Cl.
*H04S 1/00* (2006.01)
*H04R 1/02* (2006.01)

(58) Field of Classification Search
CPC ..... H04R 19/013; H04R 1/06; H04R 1/42; H04R 2201/401; H04R 2225/67; H04R 2430/20; H04R 25/00; H04R 25/604; H04R 3/00; H04R 7/045; H04R 1/083; H04R 17/10; H04R 1/025; H04R 1/026; H04R 1/28; H04R 1/2834; H04R 1/2857; H04R 1/345; H04R 2201/025; H04R 2307/025; H04R 29/001; H04R 29/002; H04R 3/06; H04R 5/02; H04R 7/127; H04R 7/18
USPC ... 381/77, 111, 116, 191, 303, 152, 312, 79, 381/117, 150, 151, 160, 174, 18, 2, 190, 381/302, 357, 387, 67 OR, 98, 94.3
See application file for complete search history.

(56) References Cited

U.S. PATENT DOCUMENTS 6,364,028 B1 * 4/2002 Ferrell ..... E02F 3/847 172/1
6,807,281 B1 * 10/2004 Sasaki ..... H04R 1/403 381/111
7,909,466 B2 * 3/2011 Fukui ..... H04S 7/40 353/121
2008/0055548 A1 * 3/2008 Matsuzawa ..... B06B 1/0603 353/15
2008/0212033 A1 * 9/2008 Fukui ..... H04S 7/40 353/15
2009/0257606 A1 * 10/2009 Sekino ..... B06B 1/0292 381/191
2009/0260422 A1 * 10/2009 Sugiura ..... G01S 7/52 73/24.04
2010/0331692 A1 * 12/2010 Kakee ..... A61B 8/06 600/443
2012/0308056 A1 * 12/2012 Nakayama ..... B60Q 9/008 381/302
2013/0030297 A1 * 1/2013 Katsuyama ..... A61B 8/0858 600/442
2013/0222704 A1 * 8/2013 Kishinami ..... H04R 3/00 348/738
2013/0315034 A1 * 11/2013 Yagihashi ..... H04R 1/32 367/103
2016/0174938 A1 * 6/2016 Takano ..... A61B 8/14 600/459

FOREIGN PATENT DOCUMENTS

CN 102461212 A 5/2012
CN 103165125 A 6/2013

* cited by examiner

INFORMATION PROCESSING METHOD AND ELECTRONIC DEVICE

CROSS-REFERENCE TO RELATED APPLICATION(S)

This application claims priority to the Chinese Patent Application no. 201510370106.5, filed on Jun. 29, 2015, entitled "INFORMATION PROCESSING METHOD AND ELECTRONIC DEVICE" which is incorporated herein by reference in its entirety.

TECHNICAL FIELD

The present disclosure relates to electronic technology, and more particularly, to an information processing method and an electronic device.

BACKGROUND

With the development of science and technology, various designs of electronic devices have been provided to meet users' increasing requirements. More and more electronic devices are capable of playing videos and displaying various types of information.

During implementation of the embodiments of the present disclosure, the inventors have found at least the following problems in the existing solutions. Conventionally, stereophonic effects are typically achieved by arranging speakers at multiple positions in an electronic device. However, mobile terminal devices typically have small dimensions and the spacing between the individual speakers is limited (e.g., by dimensions of mobile phones). It is thus difficult to obtain stereophonic effects.

SUMMARY

In an aspect, an information processing method is provided according to an embodiment of the present disclosure. The information processing method comprises: modulating a first audio signal associated with a first channel in a first sound source file onto a first ultrasound signal to obtain a first modulated ultrasound signal; modulating a second audio signal associated with a second channel in a second sound source file onto a second ultrasound signal to obtain a second modulated ultrasound signal; transmitting a first ultrasound wave associated with the first modulated ultrasound signal, such that the first ultrasound wave, once reflected by a first reflection plane, produces a first audible sound signal corresponding to the first audio signal; and transmitting a second ultrasound wave associated with the second modulated ultrasound signal, such that the second ultrasound wave, once reflected by a second reflection plane, produces a second audible sound signal corresponding to the second audio signal.

Optionally, the step of modulating the first audio signal associated with the first channel in the first sound source file onto the first ultrasound signal to obtain the first modulated ultrasound signal comprises: modulating, by a modulator circuit in an electronic device, the first audio signal at a first frequency associated with the first channel in the first sound source file onto the first ultrasound signal to obtain the first modulated ultrasound signal at a second frequency. A frequency difference between the first frequency and the second frequency is a frequency of the first audio signal.

Optionally, the step of transmitting the first ultrasound wave associated with the first modulated ultrasound signal, such that the first ultrasound wave, once reflected by the first reflection plane, produces the first audible sound signal corresponding to the first audio signal comprises: transmitting the first ultrasound wave associated with the first modulated ultrasound signal and a third ultrasound wave associated with a third ultrasound signal, such that the first ultrasound wave and the third ultrasound wave, once reflected by the first reflection plane, produces the first audible sound signal corresponding to the first audio signal, by virtue of a non-linear effect of air.

Optionally, the method further comprises: obtaining a visual file; and projecting, by a projector unit of an electronic device, the visual file onto a projection plane to produce a content to be projected on the projection plane, such that the content to be projected can be seen by a user while the first sound signal and the second sound signal can be heard by the user.

Optionally, the step of projecting, by the projector unit of the electronic device, the visual file onto the projection plane to produce the content to be projected on the projection plane, such that the content to be projected can be seen by the user while the first sound signal and the second sound signal can be heard by the user comprises: detecting a first distance from the projector unit to the projection plane and a second distance from the projection plane to the user, to obtain a first propagation path having a propagation distance that is a sum of the first distance and the second distance, and detecting a third distance from the electronic device to the first reflection plane and a fourth distance from the first reflection plane to the user, to obtain a second propagation path having a propagation distance that is a sum of the third distance and the fourth distance; determining a first time length required for light to travel across the first propagation path and a second time length required for a sound wave to travel across the second propagation path, to obtain a first time difference between the first time length and the second time length; and projecting, at a time instant when the first time difference has lapsed since the first ultrasound wave associated with the first modulated ultrasound signal and the second ultrasound wave associated with the second modulated ultrasound signal have been transmitted, by the projector unit, the content to be projected onto the projection plane, such that the content to be projected can be seen by the user while the first sound signal can be heard by the user.

In another aspect, an electronic device is provided according to an embodiment of the present disclosure. The electronic device comprises: a casing; a storage unit provided in the casing and configured to store program instructions; and a processor provided in the casing and connected to the storage unit. The program instructions, when read from the storage unit and executed by the processor, cause the processor to: modulate a first audio signal associated with a first channel in a first sound source file onto a first ultrasound signal to obtain a first modulated ultrasound signal; modulate a second audio signal associated with a second channel in a second sound source file onto a second ultrasound signal to obtain a second modulated ultrasound signal; transmit a first ultrasound wave associated with the first modulated ultrasound signal, such that the first ultrasound wave, once reflected by a first reflection plane, produces a first audible sound signal corresponding to the first audio signal; and transmit a second ultrasound wave associated with the second modulated ultrasound signal, such that the second ultrasound wave, once reflected by a second reflection plane, produces a second audible sound signal corresponding to the second audio signal.

Optionally, the processor is configured to: cause a modulator circuit in the electronic device to modulate the first audio signal at a first frequency associated with the first channel in the first sound source file onto the first ultrasound signal to obtain the first modulated ultrasound signal at a second frequency. A frequency difference between the first frequency and the second frequency is a frequency of the first audio signal.

Optionally, the processor is configured to: transmit the first ultrasound wave associated with the first modulated ultrasound signal and a third ultrasound wave associated with a third ultrasound signal, such that the first ultrasound wave and the third ultrasound wave, once reflected by the first reflection plane, produces the first audible sound signal corresponding to the first audio signal, by virtue of a non-linear effect of air.

Optionally, the electronic device further comprises: a projector unit provided in the casing and connected to the processor. The processor is further configured to: obtain a visual file; and cause the projector unit to project the visual file onto a projection plane to produce a content to be projected on the projection plane, such that the content to be projected can be seen by a user while the first sound signal and the second sound signal can be heard by the user.

Optionally, the processor is configured to: detect a first distance from the projector unit to the projection plane and a second distance from the projection plane to the user, to obtain a first propagation path having a propagation distance that is a sum of the first distance and the second distance, and detect a third distance from the electronic device to the first reflection plane and a fourth distance from the first reflection plane to the user, to obtain a second propagation path having a propagation distance that is a sum of the third distance and the fourth distance; determine a first time length required for light to travel across the first propagation path and a second time length required for a sound wave to travel across the second propagation path, to obtain a first time difference between the first time length and the second time length; and cause the projector unit to project, at a time instant when the first time difference has lapsed since the first ultrasound wave associated with the first modulated ultrasound signal and the second ultrasound wave associated with the second modulated ultrasound signal have been transmitted, the content to be projected onto the projection plane, such that the content to be projected can be seen by the user while the first sound signal can be heard by the user.

In yet another aspect, an electronic device is provided according to an embodiment of the present disclosure. The electronic device comprises: a first modulation unit configured to modulate a first audio signal associated with a first channel in a first sound source file onto a first ultrasound signal to obtain a first modulated ultrasound signal; a second modulation unit configured to modulate a second audio signal associated with a second channel in a second sound source file onto a second ultrasound signal to obtain a second modulated ultrasound signal; a first transmission unit configured to transmit a first ultrasound wave associated with the first modulated ultrasound signal, such that the first ultrasound wave, once reflected by a first reflection plane, produces a first audible sound signal corresponding to the first audio signal; and a second transmission unit configured to transmit a second ultrasound wave associated with the second modulated ultrasound signal, such that the second ultrasound wave, once reflected by a second reflection plane, produces a second audible sound signal corresponding to the second audio signal.

BRIEF DESCRIPTION OF THE DRAWINGS

In order to illustrate the solutions according to the embodiments of the present disclosure or the prior art clearly, the figures used for description of the embodiments will be introduced briefly here. It is apparent to those skilled in the art that the figures described below only illustrate some embodiments of the present invention.

DETAILED DESCRIPTION OF THE EMBODIMENTS

Figure 1:
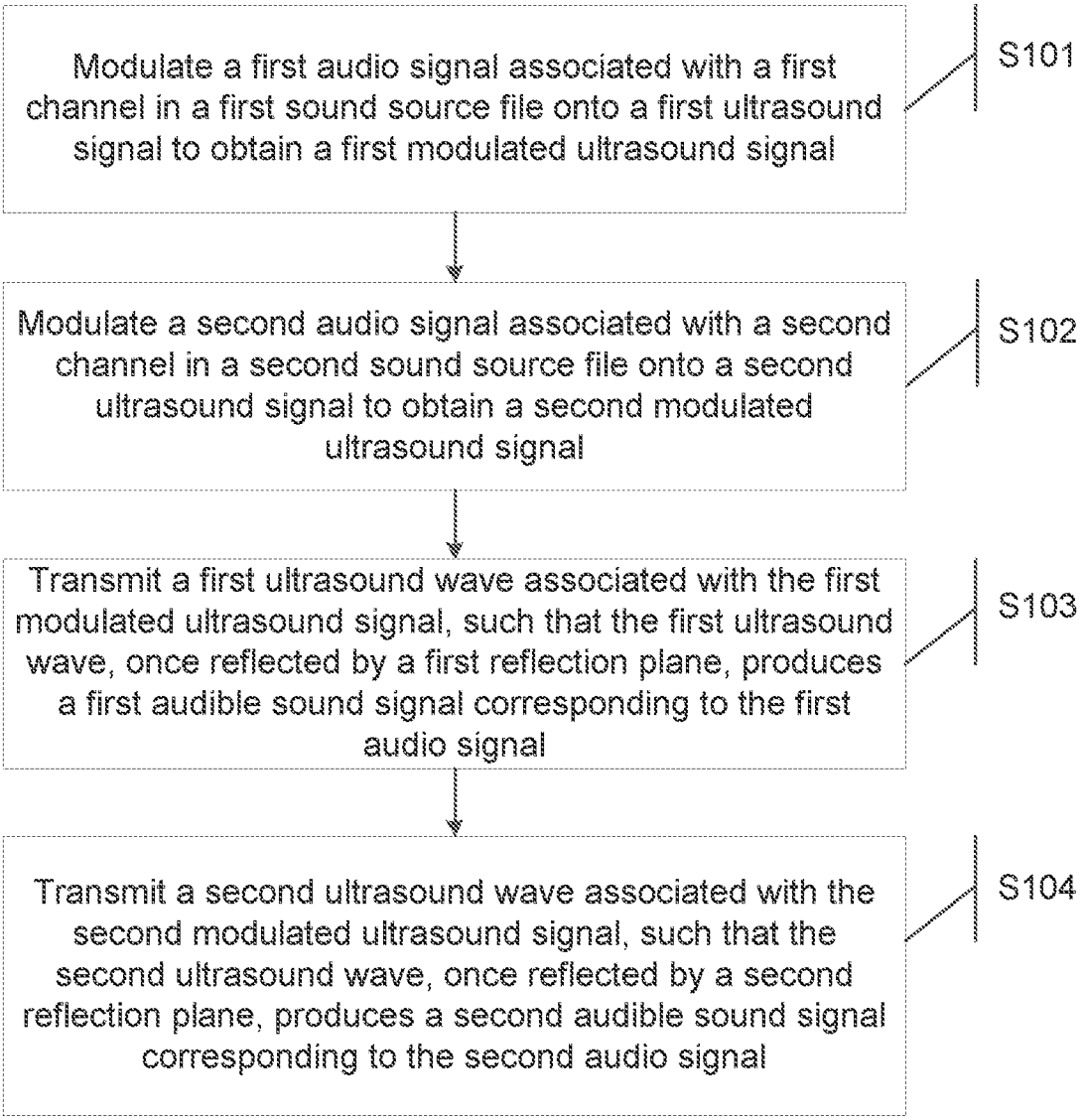
FIG. 1 is a flowchart illustrating an information processing method according to a first embodiment of the present disclosure.

The embodiments of the present disclosure provides an information processing method and an electronic device, capable of solving the technical problem that the conventional electronic devices cannot provide high-quality stereophonic effects and providing good stereophonic effects.

In order to solve the above problem, the general concept of the solutions according to the embodiments of the present disclosure is as follows.

A first audio signal associated with a first channel in a first sound source file is modulated onto a first ultrasound signal to obtain a first modulated ultrasound signal. A second audio signal associated with a second channel in a second sound source file is modulated onto a second ultrasound signal to obtain a second modulated ultrasound signal. A first ultrasound wave associated with the first modulated ultrasound signal is transmitted, such that the first ultrasound wave, once reflected by a first reflection plane, produces a first audible sound signal corresponding to the first audio signal. A second ultrasound wave associated with the second modulated ultrasound signal is transmitted, such that the second ultrasound wave, once reflected by a second reflection plane, produces a second audible sound signal corresponding to the second audio signal.

In the solutions according to the embodiments of the present disclosure, a first audio signal associated with a first channel in a first sound source file is modulated onto a first ultrasound signal to obtain a first modulated ultrasound signal. A second audio signal associated with a second channel in a second sound source file is modulated onto a second ultrasound signal to obtain a second modulated ultrasound signal. A first ultrasound wave associated with the first modulated ultrasound signal is transmitted, such that the first ultrasound wave, once reflected by a first reflection plane, produces a first audible sound signal corresponding to the first audio signal. A second ultrasound wave associated with the second modulated ultrasound signal is transmitted, such that the second ultrasound wave, once reflected by a second reflection plane, produces a second audible sound signal corresponding to the second audio signal. That is, with the directional sound propagation of ultrasound, the audible sound signals of different channels in the electronic device can be modulated onto the ultrasound carrier signals. Then, the ultrasound waves of different frequencies will be transmitted into air, such that the original, audible sound signals can be demodulated. Meanwhile, during the propagation of the ultrasound waves, the reflection of the ultrasound waves by the reflection planes allows the user to perceive an increased spacing between the sound sources of the different channels in the electronic device, thereby providing good stereophonic effects. Therefore, the solutions according to the embodiments of the present disclosure achieve good stereophonic effects.

In the following, the solutions of the present invention will be described in detail with reference to the figures and the embodiments. It should be noted that the embodiments of the present invention and their specific features are given for illustrating the solutions of the present invention and are not intended to limit the scope of the present invention. The embodiments of the present invention and their specific features can be combined with each other, provided that they do not conflict.

In the embodiments of the present disclosure, examples of the electronic device include, among others, a smart phone, a tablet computer and a desktop computer.

First Embodiment

According to the first embodiment of the present disclosure, an information processing method is provided. The method includes the following steps.

At step S101, a first audio signal associated with a first channel in a first sound source file is modulated onto a first ultrasound signal to obtain a first modulated ultrasound signal.

At step S102, a second audio signal associated with a second channel in a second sound source file is modulated onto a second ultrasound signal to obtain a second modulated ultrasound signal.

At step S103, a first ultrasound wave associated with the first modulated ultrasound signal is transmitted, such that the first ultrasound wave, once reflected by a first reflection plane, produces a first audible sound signal corresponding to the first audio signal.

At step S104, a second ultrasound wave associated with the second modulated ultrasound signal is transmitted, such that the second ultrasound wave, once reflected by a second reflection plane, produces a second audible sound signal corresponding to the second audio signal.

In the embodiment of the present disclosure, the steps S101 and S102 are not necessarily performed in any specific order, but can be performed in parallel. Similarly, the steps S103 and S104 are not necessarily performed in any specific order, but can be performed in parallel. Of course, there can be other orders in which the steps 101, 102, 103 and 104 in the embodiment of the present disclosure can be performed and the description thereof will be omitted here. FIG. 1 is a flowchart illustrating the information processing method according to the embodiment of the present disclosure.

In an example, the steps S101-S104 can be implemented as follows.

First of all, an ultrasound wave is a sound wave having a frequency higher than 20 KHz. Typically, an ultrasound wave has high energy and can be propagated substantially rectilinearly. Hence, a first audio signal associated with a first channel in a first sound source file in the electronic device can be modulated onto a first ultrasound signal to obtain a first modulated ultrasound signal. Further, in an embodiment of the present disclosure, the first audio signal and the first ultrasound signal can be generated by a signal generator in the electronic device. Here, the first audio signal serves as a modulating signal and the first ultrasound signal serves a carrier signal. In the step S101, as an specific example, the first audio signal of the first channel may have a frequency of 5 KHz, the first ultrasound signal may have a frequency of 40 KHz, the second audio signal of the second channel may have a frequency of 6 KHz and the second ultrasound signal may have a frequency of 35 KHz. By modulating the first audio signal at 5 KHz onto the first ultrasound signal at 40 KHz, the first modulated ultrasound signal at 45 KHz and 35 KHz can be obtained, i.e., the obtained signal is a mixed frequency signal. Similarly, by modulating the second audio signal at 6 KHz onto the second ultrasound signal at 35 KHz, the second modulated ultrasound signal at 41 KHz and 29 KHz can be obtained, i.e., the obtained signal is also a mixed frequency signal. Then, an ultrasound transducer in the electronic device (which is used for converting input electrical power into mechanical power, i.e., ultrasound wave, for transmission) transmits a first ultrasound wave associated with the first modulated ultrasound signal. When the first ultrasound wave is reflected by the first reflection plane, the two ultrasound waves (the ultrasound wave associated with the first ultrasound signal and the ultrasound wave associated with the first modulated ultrasound signal) are combined and thus self-demodulated, so as to produce the first audible sound signal of the first channel associated with the first ultrasound signal at 5 KHz. Similarly, the ultrasound wave associated with the second ultrasound signal and the ultrasound wave associated with the second modulated ultrasound signal are combined and thus self-demodulated, so as to produce the second audible sound signal of the second channel associated with the second ultrasound signal at 6 KHz. In an embodiment of the present disclosure, the first reflection plane and the second reflection plane can be the same plane, e.g., a projection plane where a projection screen is located. Alternatively, the first reflection plane and the second reflection plane can be two different planes. For example, when the electronic device is placed in a room, the left and right walls of the room can serve as the reflection planes, respectively. It can be appreciated by those skilled in the art that the reflection plane at which the sound signal of each channel is reflected can be designed as appropriate and the description thereof will be omitted here.

Further, the solution according to the embodiment of the present disclosure has been described above with reference to the example where there are two channels. It can be appreciated by those skilled in the art that the same technical principle can be applied to achieve multi-channel, e.g., three-channel or four-channel, stereophonic effects. Further, in the above description, the first and second audio signals have different frequencies and the first and second ultrasound signals have different frequencies. However, the solution according to the embodiment of the present disclosure also applies to the case where these frequencies are the same. Further, in order to reduce the design cost of the electronic device and to achieve a slim and light design of the electronic device, it is preferred that the carrier signals to be modulated by the audio signals can be generated by one single signal generator (e.g., an ultrasound generator that converts commercial power into high frequency AC electrical signals matching an ultrasound transducer to drive the ultrasound transducer) and the generated ultrasound signals can be multiplexed onto different channels, thereby minimizing the design cost while achieving a slim and light design of the electronic device. Further details will be omitted here for simplicity.

In an embodiment of the present disclosure, the step S101 of modulating the first audio signal associated with the first channel in the first sound source file onto the first ultrasound signal to obtain the first modulated ultrasound signal includes modulating, by a modulator circuit in an electronic device, the first audio signal at a first frequency associated with the first channel in the first sound source file onto the first ultrasound signal to obtain the first modulated ultrasound signal at a second frequency. A frequency difference between the first frequency and the second frequency is a frequency of the first audio signal.

In an implementation, the modulator circuit can obtain the first modulated ultrasound signal in, for example but not limited to, one of the following two schemes.

Scheme I

In this scheme, an ordinary audio signal can be modulated with a radio Amplitude Modulation (AM) technique to obtain an ultrasound signal. In particular, the modulating signal (e.g., the first audio signal at 5 KHz) and the carrier signal (e.g., the first ultrasound signal at 40 KHz) generated by the signal generator can be modulated by an AM circuit to produce a sum frequency signal (e.g., a sum frequency signal at 45 KHz generated from the first audio signal at 5 KHz and the first ultrasound signal at 40 KHz) and a difference frequency signal (e.g., a difference frequency signal at 35 KHz generated from the first audio signal at 5 KHz and the first ultrasound signal at 40 KHz). In this case, the sum frequency signal (e.g., at 45 KHz) can be selected by using a frequency selector, such that the ultrasound wave transmitted by the ultrasound transducer can be demodulated in the air to recover the audible first audio signal at 5 KHz. Similarly, the modulator circuit in the electronic device can modulate the second audio signal, at a third frequency, associated with the second channel in the second sound source file onto the second ultrasound signal to obtain the second modulated ultrasound signal at a fourth frequency. A frequency difference between the third frequency and the fourth frequency is a frequency of the first audio signal. That is, the modulator circuit can modulate the audio signal in the second channel to produce the second modulated ultrasound signal. It can be appreciated by those skilled in the art that the same principle can be applied to modulate other audio signals associated with multi-channels and the description thereof will be omitted here.

Scheme II

In this scheme, the audio signal in the first channel can be modulated with a diode balance mixer, to produce a sum frequency and a difference frequency of the first audio signal and the first ultrasound signal. Then, the sum frequency can be selected by using a frequency selector, i.e., the desired first modulated ultrasound signal can be obtained. Similarly, the audio signal in the second channel can be modulated to produce the desired second modulated ultrasound signal. It can be appreciated by those skilled in the art that the same principle can be applied to process audio signals associated with multi-channels to produce the desired, modulated ultrasound signals, and the description thereof will be omitted here.

Further, in an embodiment of the present disclosure, a power amplifier can be provided, following the frequency selector, as desired. Also, it can be appreciated by those skilled in the art that various circuits can be designed for modulating audio signals as appropriate and the description thereof will be omitted here.

In an embodiment of the present disclosure, once the desired modulated ultrasound signal has been produced, it can be transmitted by the ultrasound transducer. In particular, the step S303 of transmitting the first ultrasound wave associated with the first modulated ultrasound signal, such that the first ultrasound wave, once reflected by the first reflection plane, produces the first audible sound signal corresponding to the first audio signal includes transmitting the first ultrasound wave associated with the first modulated ultrasound signal and a third ultrasound wave associated with a third ultrasound signal, such that the first ultrasound wave and the third ultrasound wave, once reflected by the first reflection plane, produces the first audible sound signal corresponding to the first audio signal, by virtue of a non-linear effect of air. Specifically, the ultrasound transducer (e.g., made of a piezoelectric ceramic material) transmits the ultrasound wave associated with the modulated ultrasound signal to the air. After reflected by the first reflection plane (e.g., a wall in a room), by virtue of the non-linear acoustics effect of the air, the ultrasound wave signals (the ultrasound wave signal associated with the ultrasound signal at 45 KHz and the ultrasound wave signal associated with the first ultrasound signal at 40 KHz) will interact to be self-demodulated, so as to produce a sum of the frequencies of the original ultrasound waves (i.e., a sum frequency, which is 85 KHz in this case) and a difference between the frequencies of the original ultrasound waves (i.e., a difference frequency, which is 5 KHz in this case). Since the sum frequency signal is beyond the audible frequency limit of human (20 KHz), only the difference signal, i.e., the first sound signal at 5 KHz associated with the first audio signal here, is audible. Since the ultrasound waves have high directivity, the difference frequency wave produced due to their interaction during the propagation also has high directivity. Such high directivity of the difference frequency wave produced due to the interaction of the two ultrasound waves after reflection by the wall allows the user to hear the sound signal associated with the audio signal in the first channel while ensuring good transmission of the sound signal. Similarly, the ultrasound wave associated with the modulated ultrasound signal obtained by modulating the audio signal in the second channel and the ultrasound wave associated with the ultrasound signal interact, after reflection by the reflection plane, to produce an ultrasound wave having high directivity, so as to allow the user to hear the sound signal associated with the audio signal in the second channel. It can be appreciated by those skilled in the art that, with the same principle, when the electronic device is a multi-channel electronic device, the user can hear sound signals associated with audio signal from the respective channels. Further details will be omitted here for simplicity.

Figure 2:
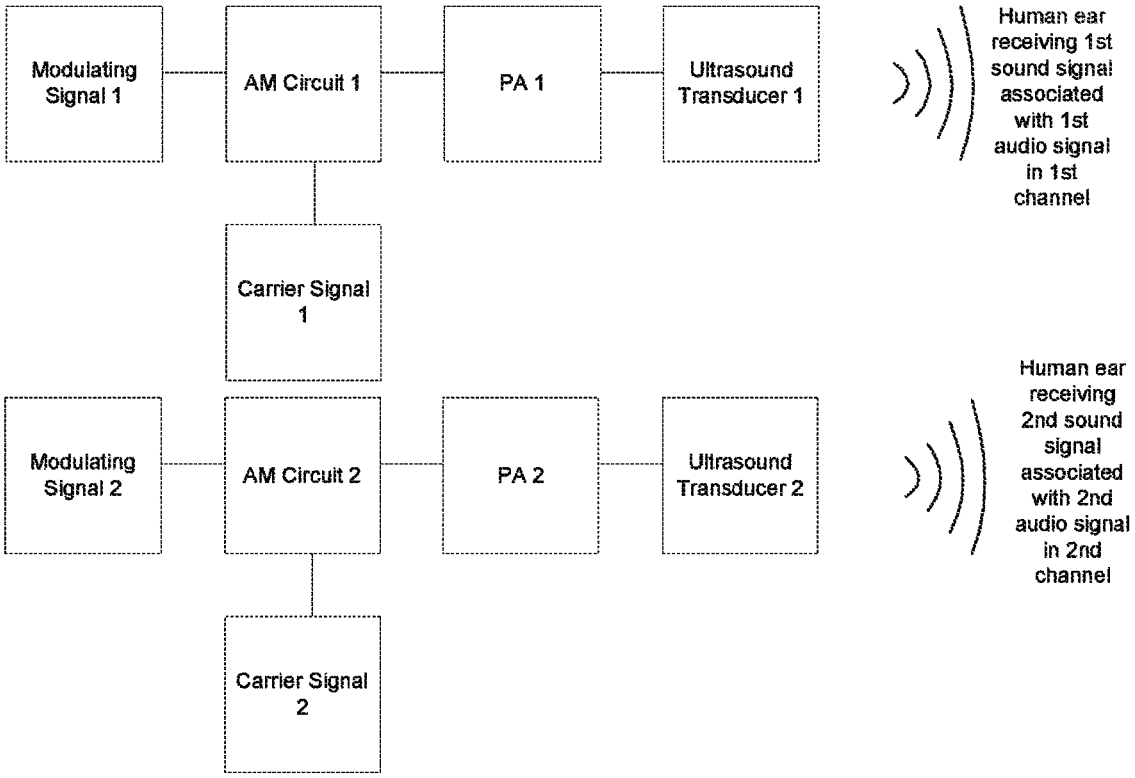
FIG. 2 is a block diagram showing a device, which can be used with the information processing method according to the first embodiment of the present disclosure, for modulating an ordinary audio signal to produce a stereo sound (a dual-channel stereo sound in this example)

Further, the principle of the step S104 is the same as that of the step S103 and thus reference can be made to the description of the step S103. In an embodiment of the present disclosure, the electronic device can have good stereophonic effects. With reference to the above description of the steps S101-S103, FIG. 2 is a block diagram showing a device for modulating an ordinary audio signal to produce a stereo sound (a dual-channel stereo sound in this example). In particular, the modulating signal is an ordinary audio signal, e.g., the first audio signal at 5 KHz as described above, generated by the signal generator associated with the sound source file, and the carrier signal is an ultrasound signal, e.g., the ultrasound signal at 40 KHz as described above, generated by the signal generator.

In an embodiment of the present disclosure, a dual-channel stereo sound is assumed again as an example. The first and second reflection planes can be the same reflection plane or different reflection planes. Further, the propagation distance of the sound wave of the first channel from the electronic device to the first reflection plane and then to the user may be different from the propagation distance of the sound wave of the second channel from the electronic device to the second reflection plane and then to the user. When the two propagation distances are different, the first sound signal of the first channel and the second sound signal of the second channel will arrive at the user's ears asynchronously. Hence, in order to ensure the synchronicity between the first sound signal and the second sound signal from different channels to be heard by the user, the time at which the sound signal of each channel is transmitted can be controlled based on the position of each ultrasound transducer on the electronic device, the distance between the ultrasound transducer and each reflection plane, and the distance between each reflection plane and the user, such that the user can hear the sound signals from the respective channels at the same time. It can be appreciated by those skilled in the art that, the same principle can be applies to other multi-channel scenarios than the dual-channel scenario to ensure the synchronicity between sound signals from different channels to be heard by the user. Further details will be omitted here for simplicity.

Further, in an embodiment of the present disclosure, when the electronic device plays a video, a visual file corresponding to the video can be obtained before transmitting the ultrasound waves associated with the modulated ultrasound signals and then the visual file can be output after the transmission. Alternatively, the visual file corresponding to the video can be obtained after transmitting the modulated ultrasound signals. This can be designed as appropriate by those skilled in the art. In addition, in the embodiment of the present disclosure, regardless of whether the visual file is obtained before or after transmitting the ultrasound waves associated with the modulated ultrasound signals, in order to ensure the synchronicity between the time at which the visual file is played and the time at which the sound signals are heard by the user, the visual file should be output after the ultrasound waves associated with the modulated ultrasound signals have been transmitted.

In an implementation, when the electronic device is in an operating state and is used by the user for multimedia playing, the information processing method according to the first embodiment of the present disclosure further includes the following steps.

At step A, a visual file is obtained.

At step B, a processor unit of the electronic device displays the visual file to obtain a content to be displayed associated with the visual file currently, such that the content to be displayed can be seen by the user while the first sound signal and the second sound signal can be heard by the user.

In particular, when the electronic device is to play a video, it first obtains a visual file corresponding to the video. Then, the processor unit of the electronic device displays the visual file to obtain the content to be displayed associated with the visual file currently. Hence, it can be ensured that the user can see the content to be displayed while hearing the sound signals corresponding to the content to be displayed. Further, it allows the electronic device to provide, when playing a multimedia file, the user with good stereophonic effects and good user experiences associated with the synchronicity between the displayed picture and the sound.

Figure 3:
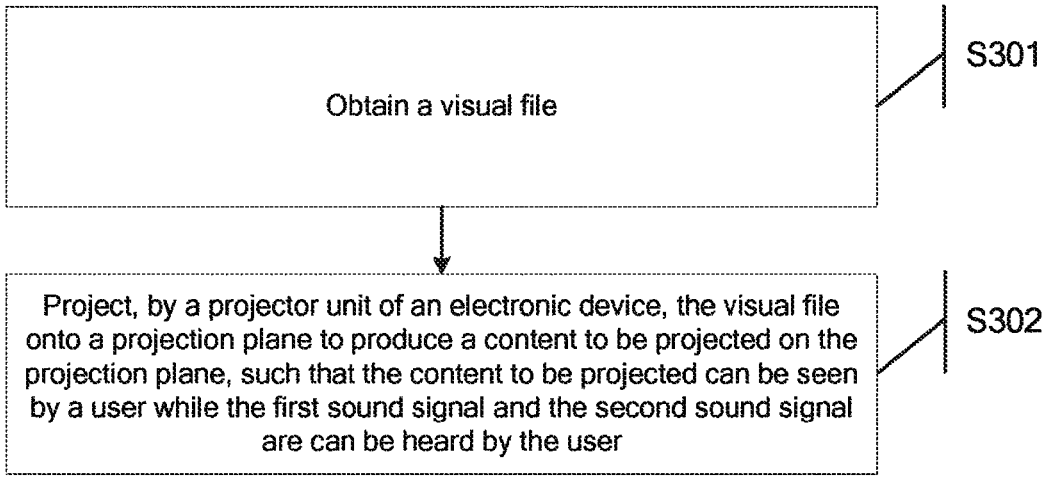
FIG. 3 is a flowchart illustrating a process for ensuring consistency between what the user sees and what the user hears during the projection display in the information processing method according to the first embodiment of the present disclosure.

Additionally, in an embodiment of the present disclosure, the processor unit of the electronic device can output the visual file to the display screen of the electronic device. Alternatively, it can project the visual file onto a projection screen for displaying. When the visual file is displayed on the display screen, it allows the user to enjoy the stereophonic experience provided by the electronic device while viewing the multimedia content displayed on the display screen of the electronic device. Further, either the screen display scheme or the projection display scheme, or any other equivalents thereof, can provide the user with a good audiovisual experience. In the following, the process for ensuring the synchronicity between what the user sees and what the user hears while the electronic device is playing multimedia content in an embodiment of the present disclosure will be explained in detail with reference to an example of projection display. Referring to FIG. 3, in an embodiment of the present disclosure, the method further includes the following steps.

At step S301, a visual file is obtained.

At step S302, a projector unit of the electronic device projects the visual file onto a projection plane to produce a content to be projected on the projection plane, such that the content to be projected can be seen by a user while the first sound signal and the second sound signal can be heard by the user.

In particular, the steps S301 and S302 can be implemented as follows.

In an embodiment of the present disclosure, when the electronic device is used by the user for playing multimedia content, a visual file corresponding to the multimedia content currently (e.g., when the user clicks to play) can be obtained first. Then, the projector unit of the electronic device can project the visual file onto a projection plane (e.g., a wall in a room) to produce a content to be projected on the projection plane. In order for the projection display to provide the user with an optimum audiovisual experience, it is generally required to ensure the synchronicity between the projected picture as seen by the user and the sound signals associated with the projected picture as heard by the user. In other words, it is required that, when the user sees the content to be projected, he/she can hear the sound signals associated with the ordinary audio signals corresponding to the content to be projected at the same time.

Figure 4:
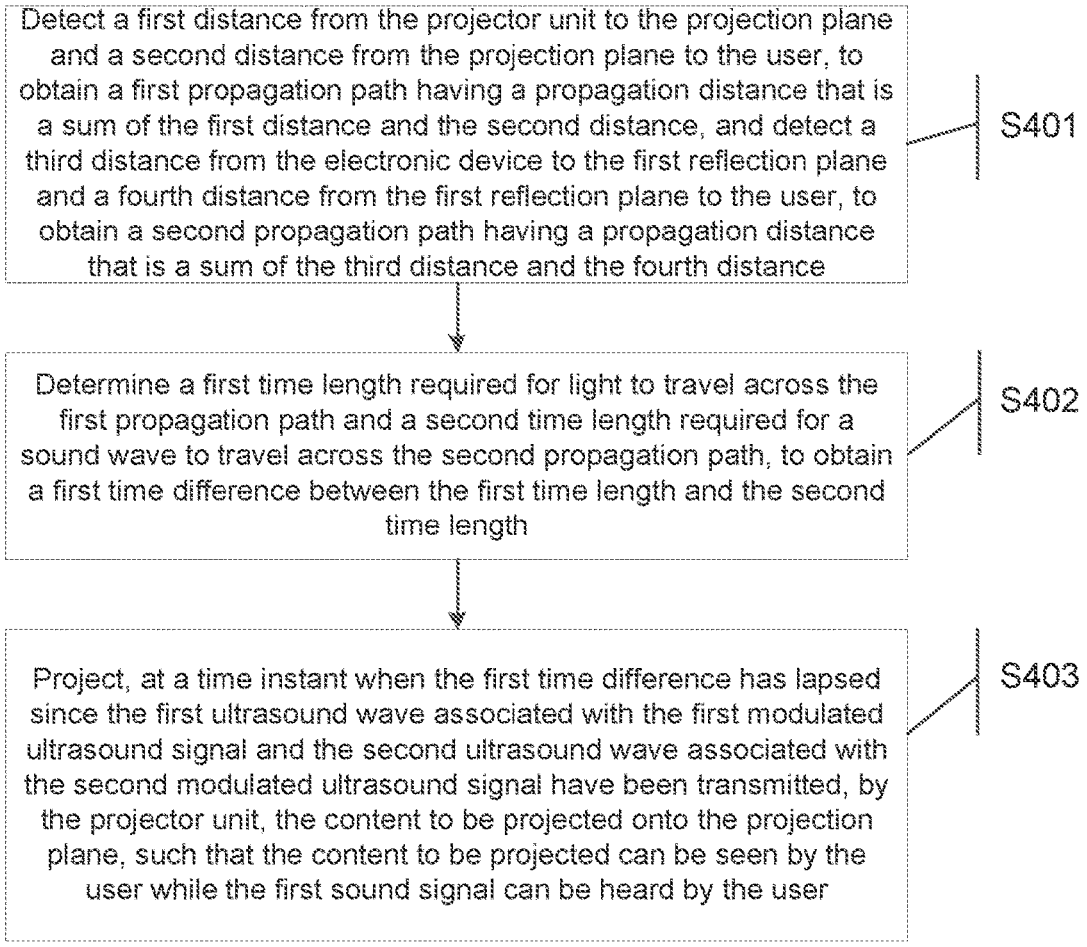
FIG. 4 is a flowchart illustrating a process for ensuring consistency between what the user sees and what the user hears during the projection display in the step S302 in the information processing method according to the first embodiment of the present disclosure.

In an embodiment of the present disclosure, in order to ensure the synchronicity between what the user sees and what the user hears, the content to be projected needs to be projected with a delay in relation to the visual content. When the projection plane and the reflection plane are the same one, referring to FIG. 4, the step 302 of projecting, by the projector unit of the electronic device, the visual file onto the projection plane to produce the content to be projected on the projection plane, such that the content to be projected can be seen by the user while the first sound signal and the second sound signal can be heard by the user includes the following steps.

At step S401, a first distance from the projector unit to the projection plane and a second distance from the projection plane to the user are detected, to obtain a first propagation path having a propagation distance that is a sum of the first distance and the second distance. A third distance from the electronic device to the first reflection plane and a fourth distance from the first reflection plane to the user are detected, to obtain a second propagation path having a propagation distance that is a sum of the third distance and the fourth distance.

At step S402, a first time length required for light to travel across the first propagation path and a second time length required for a sound wave to travel across the second propagation path are determined, to obtain a first time difference between the first time length and the second time length.

At step S403, at a time instant when the first time difference has lapsed since the first ultrasound wave associated with the first modulated ultrasound signal and the second ultrasound wave associated with the second modulated ultrasound signal have been transmitted, the projector unit projects the content to be projected onto the projection plane, such that the content to be projected can be seen by the user while the first sound signal can be heard by the user.

In particular, the steps S401-S403 can be implemented as follows.

First, a first distance from the projector unit to the projection plane and a second distance from the projection plane to the user are detected, to obtain a first propagation path having a propagation distance that is a sum of the first distance and the second distance. Once the first propagation path has been determined, a first time length required for light to travel across the first propagation path can be determined. In addition, a third distance from the electronic device to the first reflection plane and a fourth distance from the first reflection plane to the user are detected, such that a second time length required for a sound wave to travel across the second propagation path can be determined. Hence, a first time difference between the first time length and the second time length can be obtained. Then, a first time instant at which the first ultrasound wave associated with the first modulated ultrasound signal and the second ultrasound wave associated with the second modulated ultrasound signal are transmitted can be obtained. Once the first time instant has been obtained, the projector unit projects the content to be projected onto the projection plane at a second time instant when the first time difference has lapsed since the first time instant, such that the content to be projected can be seen by the user while the first sound signal can be heard by the user. Similarly, such synchronicity can be ensured for channels other than the first channel.

Figure 5:
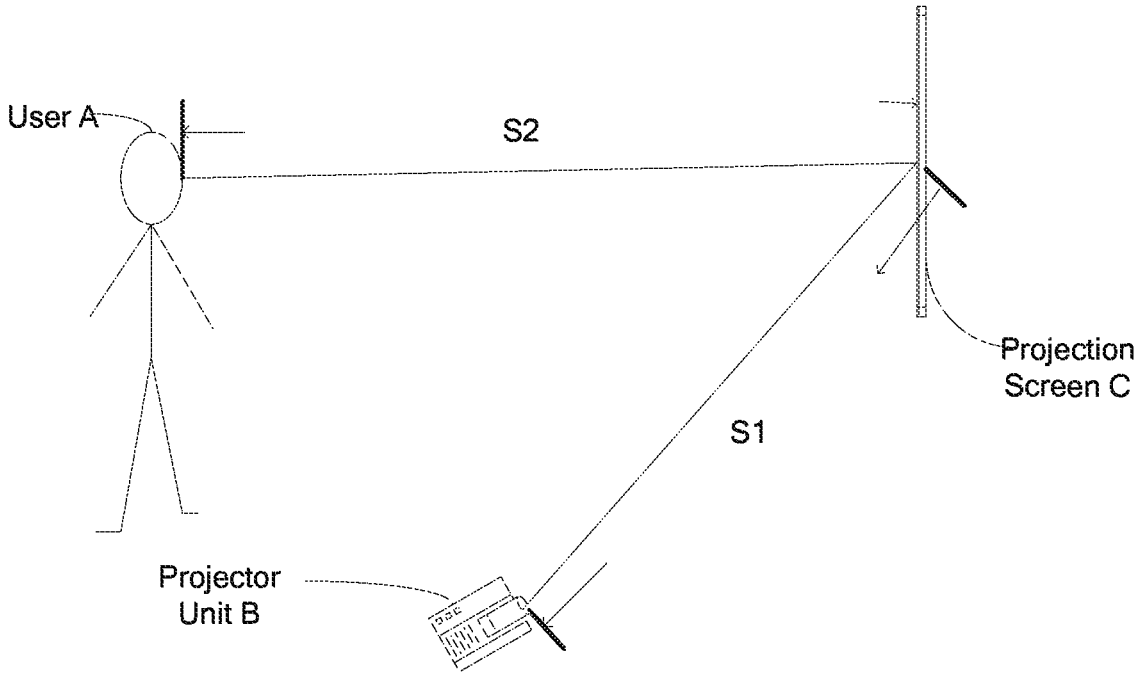
FIG. 5 is a schematic diagram showing a positional relation among a user A, a projector unit B and a projection screen C when the user A projects a multimedia video using a projector unit in a smart phone and the projection plane is the same as the reflection plane, in the information processing method according to the first embodiment of the present disclosure.

Additionally, in an embodiment of the present disclosure, the reflection plane for reflecting the ultrasound wave and the projection plane for displaying the content to be projected to the user can be the same plane or different planes. This can be designed as appropriate by those skilled in the art. In particular, in an embodiment of the present disclosure, when the projection plane is the same as the first reflection plane (in this case, the first distance is the same as the third distance and the second distance is the same as the fourth distance) and the electronic device provides the user with the first channel, in order to ensure the synchronicity between what the user sees and what the user hears, the time interval between the time when the electronic device projects the content to be projected and the time when the electronic device transmits the ultrasound wave can be designed based on the time required for propagations of sound and light. As an example, FIG. 5 is a schematic diagram showing a positional relation among a user A, a projector unit B and a projection screen C when the user A projects a multimedia video using a projector unit in a smart phone and the projection plane is the same as the reflection plane. An infrared detector in the smart phone can detect the first distance, S1, from the projector unit B to the projection screen C and the second distance, S2, from the projection screen C to the user A. Accordingly, the first propagation path, S, having a distance that is the sum of the first distance S1 and the second distance S2, across which the sound signal travels from the projector unit B to the user A via the projection screen C, can be obtained. Since the content to be projected is projected at the speed of light and the speed of light c, and the speed of sound, v, in the air are typically constant, the first time length required for the content to be projected to travel from the projector unit B to the user A via the projection screen C can be calculated as $t1=(S1+S2)/(2c)$. Similarly, the second time length required for the sound signal to travel from the projector unit B to the user A via the projection screen C can be calculated as $t2=(S1+S2)/(2v)$. Since the speed of light is higher than the speed of sound, in order to ensure the synchronicity between what the user sees and what the user hears, the projector unit can be controlled to project with a delay of $(t2-t1)$ in relation to the time when the ultrasound wave associated with the modulated ultrasound signal is transmitted. Similarly, by adjusting the locations of the respective ultrasound transducers associated with other channels in the electronic device and controlling the time to project, it is possible to ensure the synchronicity between what the user sees and what the user hears for other channels. Further details will be omitted here for simplicity.

Figure 6:
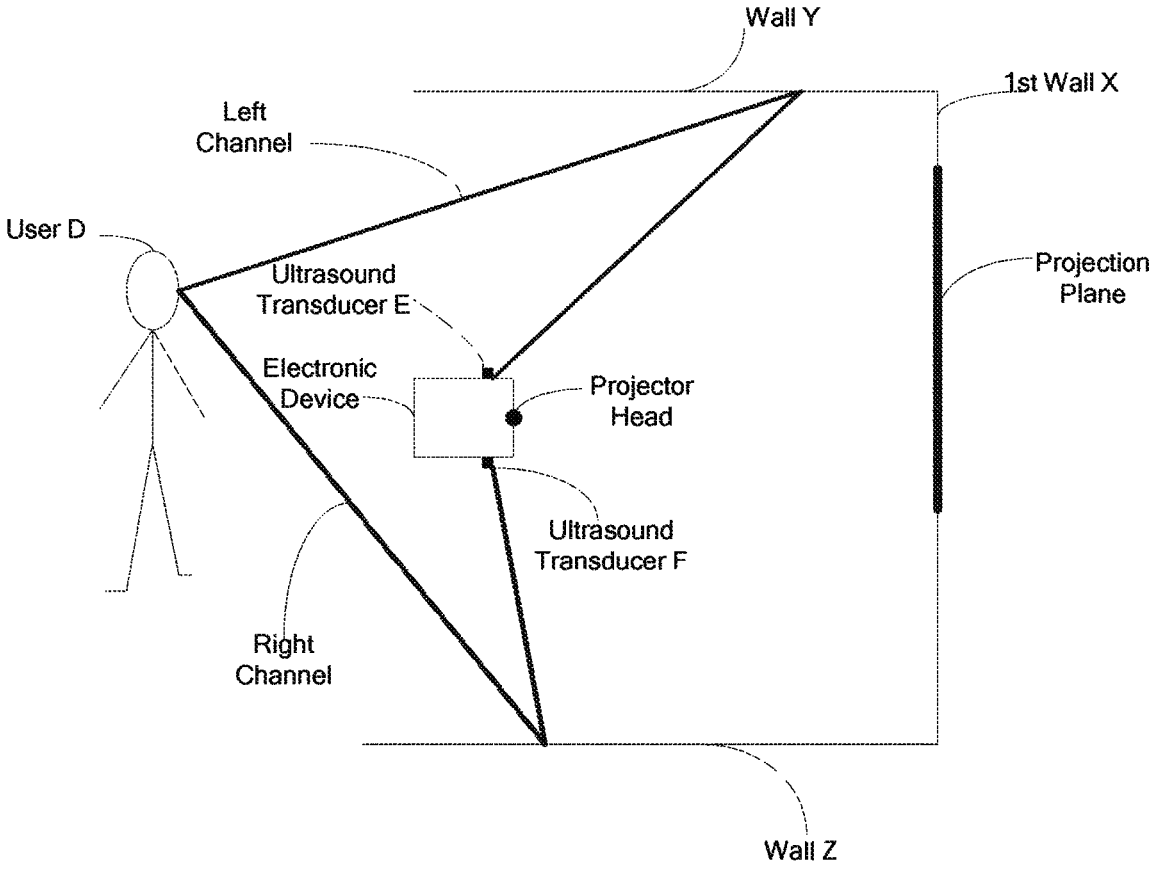
FIG. 6 is a schematic diagram showing a process for producing a dual-channel stereo sound audible to the user when the projection plane is different from the reflection plane, in the information processing method according to the first embodiment of the present disclosure.

In an embodiment of the present disclosure, the projection plane and the reflection plane can be different planes. Here, the solution according to the embodiment of the present disclosure will be explained with reference to an example where the user hears a dual-channel stereo sound. In this example, when a user D uses a projector unit in a smart phone to project a multimedia video, the projector head of the projector unit faces towards a first wall X in front of the user D. Two ultrasound transducers E and F are provided on two sides of the first wall X, respectively. The user D can hear a dual channel stereo sound, as shown in FIG. 6. In particular, the user D can hear a first sound signal from a first channel and a second sound signal from a second channel. In an embodiment of the present disclosure, the locations of the respective ultrasound transducers in the electronic device can be designed by those skilled in the art to meet the user's audiovisual requirements, depending on different application scenarios (e.g., home theater, personal view, conference, etc.).

Second Embodiment

Figure 7:
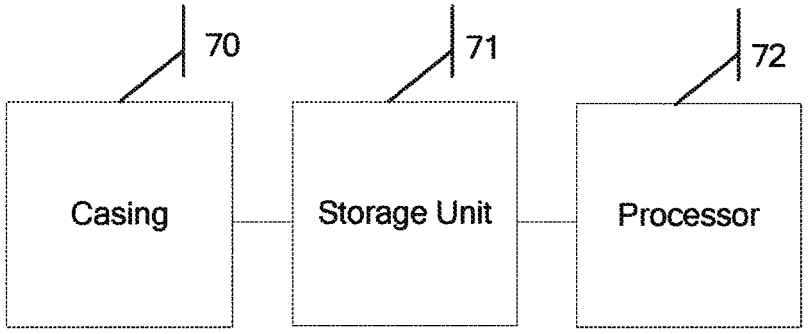
FIG. 7 is a block diagram showing a structure of an electronic device according to a second embodiment of the present disclosure.

Based on the same inventive concept as the first embodiment, referring to FIG. 7, an electronic device is provided according to a second embodiment of the present disclosure. The electronic device includes: a casing 70; a storage unit 71 provided in the casing 70 and configured to store program instructions; and a processor 72 provided in the casing 70 and connected to the storage unit 71.

The program instructions, when read from the storage unit 71 and executed by the processor 72, cause the processor 72 to: modulate a first audio signal associated with a first channel in a first sound source file onto a first ultrasound signal to obtain a first modulated ultrasound signal; modulate a second audio signal associated with a second channel in a second sound source file onto a second ultrasound signal to obtain a second modulated ultrasound signal; transmit a first ultrasound wave associated with the first modulated ultrasound signal, such that the first ultrasound wave, once reflected by a first reflection plane, produces a first audible sound signal corresponding to the first audio signal; and transmit a second ultrasound wave associated with the second modulated ultrasound signal, such that the second ultrasound wave, once reflected by a second reflection plane, produces a second audible sound signal corresponding to the second audio signal.

In an embodiment of the present disclosure, the processor 72 is configured to: cause a modulator circuit in the electronic device to modulate the first audio signal at a first frequency associated with the first channel in the first sound source file onto the first ultrasound signal to obtain the first modulated ultrasound signal at a second frequency. A frequency difference between the first frequency and the second frequency is a frequency of the first audio signal.

In an embodiment of the present disclosure, the processor 72 is configured to: transmit the first ultrasound wave associated with the first modulated ultrasound signal and a third ultrasound wave associated with a third ultrasound signal, such that the first ultrasound wave and the third ultrasound wave, once reflected by the first reflection plane, produces the first audible sound signal corresponding to the first audio signal, by virtue of a non-linear effect of air.

In an embodiment, the electronic device further includes a projector unit provided in the casing and connected to the processor 72. The processor 72 is further configured to: obtain a visual file; and cause the projector unit to project the visual file onto a projection plane to produce a content to be projected on the projection plane, such that the content to be projected can be seen by a user while the first sound signal and the second sound signal can be heard by the user.

In an embodiment of the present disclosure, the processor 72 is configured to: detect a first distance from the projector unit to the projection plane and a second distance from the projection plane to the user, to obtain a first propagation path having a propagation distance that is a sum of the first distance and the second distance, and detect a third distance from the electronic device to the first reflection plane and a fourth distance from the first reflection plane to the user, to obtain a second propagation path having a propagation distance that is a sum of the third distance and the fourth distance; determine a first time length required for light to travel across the first propagation path and a second time length required for a sound wave to travel across the second propagation path, to obtain a first time difference between the first time length and the second time length; and cause the projector unit to project, at a time instant when the first time difference has lapsed since the first ultrasound wave associated with the first modulated ultrasound signal and the second ultrasound wave associated with the second modulated ultrasound signal have been transmitted, the content to be projected onto the projection plane, such that the content to be projected can be seen by the user while the first sound signal can be heard by the user.

Third Embodiment

Figure 8:
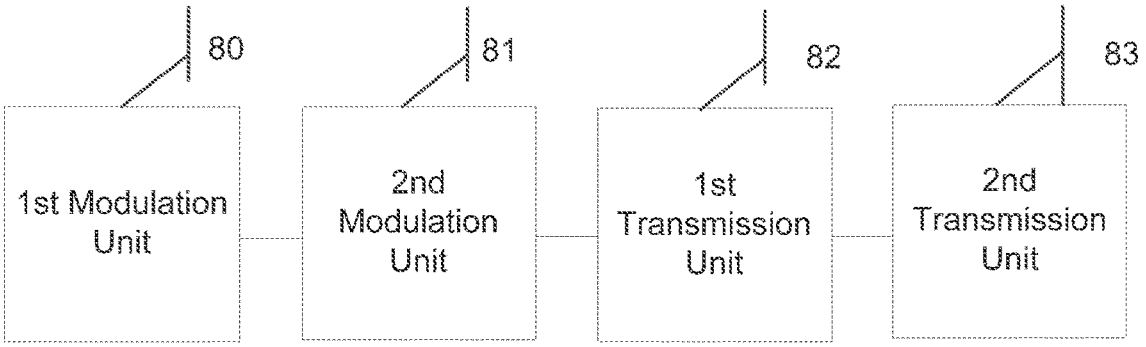
FIG. 8 is a block diagram showing a structure of an electronic device according to a third embodiment of the present disclosure.

Based on the same inventive concept as the first embodiment, referring to FIG. 8, an electronic device is provided according to a third embodiment of the present disclosure. The electronic device includes the following units.

A first modulation unit 80 is configured to modulate a first audio signal associated with a first channel in a first sound source file onto a first ultrasound signal to obtain a first modulated ultrasound signal.

A second modulation unit 81 is configured to modulate a second audio signal associated with a second channel in a second sound source file onto a second ultrasound signal to obtain a second modulated ultrasound signal.

A first transmission unit 82 is configured to transmit a first ultrasound wave associated with the first modulated ultrasound signal, such that the first ultrasound wave, once reflected by a first reflection plane, produces a first audible sound signal corresponding to the first audio signal.

A second transmission unit 83 is configured to transmit a second ultrasound wave associated with the second modulated ultrasound signal, such that the second ultrasound wave, once reflected by a second reflection plane, produces a second audible sound signal corresponding to the second audio signal.

In an embodiment of the present disclosure, the first modulation unit 80 is configured to modulate, by a modulator circuit in an electronic device, the first audio signal at a first frequency associated with the first channel in the first sound source file onto the first ultrasound signal to obtain the first modulated ultrasound signal at a second frequency. A frequency difference between the first frequency and the second frequency is a frequency of the first audio signal.

In an embodiment of the present disclosure, the first transmission unit 82 is configured to transmit the first ultrasound wave associated with the first modulated ultrasound signal and a third ultrasound wave associated with a third ultrasound signal, such that the first ultrasound wave and the third ultrasound wave, once reflected by the first reflection plane, produces the first audible sound signal corresponding to the first audio signal, by virtue of a non-linear effect of air.

In an embodiment of the present disclosure, the electronic device further includes a first obtaining unit configured to obtain a visual file; and a second obtaining unit configured to project, by a projector unit of an electronic device, the visual file onto a projection plane to produce a content to be projected on the projection plane, such that the content to be projected can be seen by a user while the first sound signal and the second sound signal are can be heard by the user.

In an embodiment of the present disclosure, the second obtaining unit includes: a first obtaining module configured to detect a first distance from the projector unit to the projection plane and a second distance from the projection plane to the user, to obtain a first propagation path having a propagation distance that is a sum of the first distance and the second distance, and detect a third distance from the electronic device to the first reflection plane and a fourth distance from the first reflection plane to the user, to obtain a second propagation path having a propagation distance that is a sum of the third distance and the fourth distance; a first determining module configured to determine a first time length required for light to travel across the first propagation path and a second time length required for a sound wave to travel across the second propagation path, to obtain a first time difference between the first time length and the second time length; and a first projecting module configured to project, at a time instant when the first time difference has lapsed since the first ultrasound wave associated with the first modulated ultrasound signal and the second ultrasound wave associated with the second modulated ultrasound signal have been transmitted, by the projector unit, the content to be projected onto the projection plane, such that the content to be projected can be seen by the user while the first sound signal can be heard by the user.

One or more solutions according the above embodiments of the present disclosure have at least the following one or more technical effects.

In a solution according to the embodiment of the present disclosure, a first audio signal associated with a first channel in a first sound source file is modulated onto a first ultrasound signal to obtain a first modulated ultrasound signal. A second audio signal associated with a second channel in a second sound source file is modulated onto a second ultrasound signal to obtain a second modulated ultrasound signal. A first ultrasound wave associated with the first modulated ultrasound signal is transmitted, such that the first ultrasound wave, once reflected by a first reflection plane, produces a first audible sound signal corresponding to the first audio signal. A second ultrasound wave associated with the second modulated ultrasound signal is transmitted, such that the second ultrasound wave, once reflected by a second reflection plane, produces a second audible sound signal corresponding to the second audio signal. That is, with the directional sound propagation of ultrasound, the audible sound signals of different channels in the electronic device can be modulated onto the ultrasound carrier signals. Then, the ultrasound waves of different frequencies will be transmitted into air, such that the original, audible sound signals can be demodulated. Meanwhile, during the propagation of the ultrasound waves, the reflection of the ultrasound waves by the reflection planes allows the user to perceive an increased spacing between the sound sources of the different channels in the electronic device, thereby providing good stereophonic effects. Therefore, the solution according to the embodiment of the present disclosure achieves good stereophonic effects.

In a solution according to the embodiment of the present disclosure, a first audio signal associated with a first channel in a first sound source file is modulated onto a first ultrasound signal to obtain a first modulated ultrasound signal. A second audio signal associated with a second channel in a second sound source file is modulated onto a second ultrasound signal to obtain a second modulated ultrasound signal. A first ultrasound wave associated with the first modulated ultrasound signal is transmitted, such that the first ultrasound wave, once reflected by a first reflection plane, produces a first audible sound signal corresponding to the first audio signal. A second ultrasound wave associated with the second modulated ultrasound signal is transmitted, such that the second ultrasound wave, once reflected by a second reflection plane, produces a second audible sound signal corresponding to the second audio signal. Due to high directivity of ultrasound waves, the ultrasound waves associated with the modulated signals have high directivity during propagation of the ultrasound waves. The ultrasound waves associated with the modulated signals as reflected by the reflection planes also have high directivity. Therefore, it is possible to allow the sound signals associated with the audio signals in the respective channels in the electronic device to be audible to the user while ensuring good directivity of the sound signals.

In a solution according to the embodiment of the present disclosure, a first distance from the projector unit to the projection plane and a second distance from the projection plane to the user are detected, to obtain a first propagation path having a propagation distance that is a sum of the first distance and the second distance. A third distance from the electronic device to the first reflection plane and a fourth distance from the first reflection plane to the user are detected, to obtain a second propagation path having a propagation distance that is a sum of the third distance and the fourth distance. A first time length required for light to travel across the first propagation path and a second time length required for a sound wave to travel across the second propagation path are determined, to obtain a first time difference between the first time length and the second time length. At a time instant when the first time difference has lapsed since the first ultrasound wave associated with the first modulated ultrasound signal and the second ultrasound wave associated with the second modulated ultrasound signal have been transmitted, the projector unit projects the content to be projected onto the projection plane, such that the content to be projected can be seen by the user while the first sound signal can be heard by the user. In this way, it is possible to ensure high consistency between what the user sees and what the user hears. Therefore, the user can be provided with good audiovisual experiences while ensuring high consistency between what the user sees and what the user hears.

It can be appreciated by those skilled in the art that the embodiments of the present disclosure can be implemented as a method, a system or a computer program product. The present disclosure may include pure hardware embodiments, pure software embodiments and any combination thereof. Also, the present disclosure may include a computer program product implemented on one or more computer readable storage medium (including, but not limited to, magnetic disk storage, CD-ROM, optical storage) containing computer readable program codes.

The present disclosure have been described with reference to the flowcharts and/or block diagrams of the method, device (system) and computer program product according to the embodiments of the present disclosure. It can be appreciated that each process and/or block in the flowcharts and/or block diagrams, or any combination thereof, can be implemented by computer program instructions. Such computer program instructions can be provided to a general computer, a dedicated computer, an embedded processor or a processor of any other programmable data processing device to constitute a machine, such that the instructions executed by the computer or the processor of any other programmable data processing device can constitute means for implementing the functions specified by one or more processes in the flowcharts and/or one or more blocks in the block diagrams.

These computer program instructions can also be stored in a computer readable memory that can direct a computer or any other programmable data processing device to operate in a particular way. Thus, the instructions stored in the computer readable memory constitute an article of manufacture including instruction means for implementing the functions specified by one or more processes in the flowcharts and/or one or more blocks in the block diagrams.

These computer program instructions can also be loaded onto a computer or any other programmable data processing device, such that the computer or the programmable data processing device can perform a series of operations/steps to achieve a computer-implemented process. In this way, the instructions executed on the computer or the programmable data processing device can provide steps for implementing the functions specified by one or more processes in the flowcharts and/or one or more blocks in the block diagrams.

In particular, the computer program instructions for implementing the information processing method according to the embodiment of the present disclosure can be stored on a storage medium such as an optical disc, a hard disk or a flash memory. The computer program instructions stored in the storage medium for implementing the information processing method include, when read or executed by an electronic device, the following steps of: modulating a first audio signal associated with a first channel in a first sound source file onto a first ultrasound signal to obtain a first modulated ultrasound signal; modulating a second audio signal associated with a second channel in a second sound source file onto a second ultrasound signal to obtain a second modulated ultrasound signal; transmitting a first ultrasound wave associated with the first modulated ultrasound signal, such that the first ultrasound wave, once reflected by a first reflection plane, produces a first audible sound signal corresponding to the first audio signal; and transmitting a second ultrasound wave associated with the second modulated ultrasound signal, such that the second ultrasound wave, once reflected by a second reflection plane, produces a second audible sound signal corresponding to the second audio signal.

Optionally, the computer program instructions stored in the storage medium for modulating the first audio signal associated with the first channel in the first sound source file onto the first ultrasound signal to obtain the first modulated ultrasound signal include computer program instructions, when executed, for: modulating, by a modulator circuit in an electronic device, the first audio signal at a first frequency associated with the first channel in the first sound source file onto the first ultrasound signal to obtain the first modulated ultrasound signal at a second frequency. A frequency difference between the first frequency and the second frequency is a frequency of the first audio signal.

Optionally, the computer program instructions stored in the storage medium for transmitting the first ultrasound wave associated with the first modulated ultrasound signal, such that the first ultrasound wave, once reflected by the first reflection plane, produces the first audible sound signal corresponding to the first audio signal include computer program instructions, when executed, for: transmitting the first ultrasound wave associated with the first modulated ultrasound signal and a third ultrasound wave associated with a third ultrasound signal, such that the first ultrasound wave and the third ultrasound wave, once reflected by the first reflection plane, produces the first audible sound signal corresponding to the first audio signal, by virtue of a non-linear effect of air.

Optionally, the computer program instructions stored in the storage medium further include computer program instructions, when executed, for: obtaining a visual file; and projecting, by a projector unit of an electronic device, the visual file onto a projection plane to produce a content to be projected on the projection plane, such that the content to be projected can be seen by a user while the first sound signal and the second sound signal are can be heard by the user.

Optionally, the computer program instructions stored in the storage medium for projecting, by the projector unit of the electronic device, the visual file onto the projection plane to produce the content to be projected on the projection plane, such that the content to be projected can be seen by the user while the first sound signal and the second sound signal can be heard by the user include computer program instructions, when executed, for: detecting a first distance from the projector unit to the projection plane and a second distance from the projection plane to the user, to obtain a first propagation path having a propagation distance that is a sum of the first distance and the second distance, and detecting a third distance from the electronic device to the first reflection plane and a fourth distance from the first reflection plane to the user, to obtain a second propagation path having a propagation distance that is a sum of the third distance and the fourth distance; determining a first time length required for light to travel across the first propagation path and a second time length required for a sound wave to travel across the second propagation path, to obtain a first time difference between the first time length and the second time length; and projecting, at a time instant when the first time difference has lapsed since the first ultrasound wave associated with the first modulated ultrasound signal and the second ultrasound wave associated with the second modulated ultrasound signal have been transmitted, by the projector unit, the content to be projected onto the projection plane, such that the content to be projected can be seen by the user while the first sound signal can be heard by the user.

While the preferred embodiments of the present disclosure have been described above, various modifications and alternatives to these embodiments can be made by those skilled in the art based on the fundamental inventive concept. Therefore, these preferred embodiments and all the modifications and alternatives falling within the scope of the present disclosure are to be encompassed by the claims as attached.

Obviously, various modifications and alternatives can be made to the present disclosure by those skilled in the art without departing from the spirit and scope of the present disclosure. Therefore, these modifications and alternatives are to be encompassed by the present disclosure if they fall within the scope of the claims and their equivalents.

What is claimed is:

1. An information processing method, comprising:

modulating a first audio signal associated with a first channel in a first sound source file onto a first ultrasound signal to obtain a first modulated ultrasound signal;

modulating a second audio signal associated with a second channel in a second sound source file onto a second ultrasound signal to obtain a second modulated ultrasound signal;

transmitting a first ultrasound wave associated with the first modulated ultrasound signal, such that the first ultrasound wave, once reflected by a first reflection plane, produces a first audible sound signal corresponding to the first audio signal; and transmitting a second ultrasound wave associated with the second modulated ultrasound signal, such that the second ultrasound wave, once reflected by a second reflection plane, produces a second audible sound signal corresponding to the second audio signal, wherein said modulating the first audio signal associated with the first channel in the first sound source file onto the first ultrasound signal to obtain the first modulated ultrasound signal comprises modulating, by a modulator circuit in an electronic device, the first audio signal at a first frequency associated with the first channel in the first sound source file onto the first ultrasound signal to obtain the first modulated ultrasound signal at a second frequency, and wherein a frequency difference between the first frequency and the second frequency is a frequency of the first ultrasound signal.

2. The method of claim 1, wherein said transmitting the first ultrasound wave associated with the first modulated ultrasound signal, such that the first ultrasound wave, once reflected by the first reflection plane, produces the first audible sound signal corresponding to the first audio signal comprises:

transmitting the first ultrasound wave associated with the first modulated ultrasound signal and a third ultrasound wave associated with a third ultrasound signal, such that the first ultrasound wave and the third ultrasound wave, once reflected by the first reflection plane, produces the first audible sound signal corresponding to the first audio signal, by virtue of a non-linear effect of air.

3. The method of claim 1, further comprising:

obtaining a visual file; and projecting, by a projector unit of an electronic device, the visual file onto a projection plane to produce a content to be projected on the projection plane, such that the content to be projected can be seen by a user while the first sound signal and the second sound signal are can be heard by the user.

4. The method of claim 3, wherein said projecting, by the projector unit of the electronic device, the visual file onto the projection plane to produce the content to be projected on the projection plane, such that the content to be projected can be seen by the user while the first sound signal and the second sound signal can be heard by the user comprises:

detecting a first distance from the projector unit to the projection plane and a second distance from the projection plane to the user, to obtain a first propagation path having a propagation distance that is a sum of the first distance and the second distance, and detecting a third distance from the electronic device to the first reflection plane and a fourth distance from the first reflection plane to the user, to obtain a second propagation path having a propagation distance that is a sum of the third distance and the fourth distance;

determining a first time length required for light to travel across the first propagation path and a second time length required for a sound wave to travel across the second propagation path, to obtain a first time difference between the first time length and the second time length; and projecting, at a time instant when the first time difference has lapsed since the first ultrasound wave associated with the first modulated ultrasound signal and the second ultrasound wave associated with the second modulated ultrasound signal have been transmitted, by the projector unit, the content to be projected onto the projection plane, such that the content to be projected can be seen by the user while the first sound signal can be heard by the user.

5. An electronic device, comprising:

a casing;

a storage unit provided in the casing and configured to store program instructions; and a processor provided in the casing and connected to the storage unit, wherein the program instructions, when read from the storage unit and executed by the processor, cause the processor to:

modulate a first audio signal associated with a first channel in a first sound source file onto a first ultrasound signal to obtain a first modulated ultrasound signal;

modulate a second audio signal associated with a second channel in a second sound source file onto a second ultrasound signal to obtain a second modulated ultrasound signal;

transmit a first ultrasound wave associated with the first modulated ultrasound signal, such that the first ultrasound wave, once reflected by a first reflection plane, produces a first audible sound signal corresponding to the first audio signal; and transmit a second ultrasound wave associated with the second modulated ultrasound signal, such that the second ultrasound wave, once reflected by a second reflection plane, produces a second audible sound signal corresponding to the second audio signal, wherein the processor is configured to cause a modulator circuit in the electronic device to modulate the first audio signal at a first frequency associated with the first channel in the first sound source file onto the first ultrasound signal to obtain the first modulated ultrasound signal at a second frequency, and wherein a frequency difference between the first frequency and the second frequency is a frequency of the first ultrasound signal.

6. The electronic device of claim 5, wherein the processor is configured to:

transmit the first ultrasound wave associated with the first modulated ultrasound signal and a third ultrasound wave associated with a third ultrasound signal, such that the first ultrasound wave and the third ultrasound wave, once reflected by the first reflection plane, produces the first audible sound signal corresponding to the first audio signal, by virtue of a non-linear effect of air.

7. The electronic device of claim 5, further comprising:

a projector unit provided in the casing and connected to the processor, wherein the processor is further configured to:

obtain a visual file; and cause the projector unit to project the visual file onto a projection plane to produce a content to be projected on the projection plane, such that the content to be projected can be seen by a user while the first sound signal and the second sound signal can be heard by the user.

8. The electronic device of claim 7, wherein the processor is configured to:

detect a first distance from the projector unit to the projection plane and a second distance from the projection plane to the user, to obtain a first propagation path having a propagation distance that is a sum of the first distance and the second distance, and detect a third distance from the electronic device to the first reflection plane and a fourth distance from the first reflection plane to the user, to obtain a second propagation path having a propagation distance that is a sum of the third distance and the fourth distance;

determine a first time length required for light to travel across the first propagation path and a second time length required for a sound wave to travel across the second propagation path, to obtain a first time difference between the first time length and the second time length; and cause the projector unit to project, at a time instant when the first time difference has lapsed since the first ultrasound wave associated with the first modulated ultrasound signal and the second ultrasound wave associated with the second modulated ultrasound signal have been transmitted, the content to be projected onto the projection plane, such that the content to be projected can be seen by the user while the first sound signal can be heard by the user.

9. An electronic device, comprising:

a first modulation unit configured to modulate a first audio signal associated with a first channel in a first sound source file onto a first ultrasound signal to obtain a first modulated ultrasound signal;

a second modulation unit configured to modulate a second audio signal associated with a second channel in a second sound source file onto a second ultrasound signal to obtain a second modulated ultrasound signal;

a first transmission unit configured to transmit a first ultrasound wave associated with the first modulated ultrasound signal, such that the first ultrasound wave, once reflected by a first reflection plane, produces a first audible sound signal corresponding to the first audio signal; and a second transmission unit configured to transmit a second ultrasound wave associated with the second modulated ultrasound signal, such that the second ultrasound wave, once reflected by a second reflection plane, produces a second audible sound signal corresponding to the second audio signal, wherein the first modulation unit is configured to modulate the first audio signal at a first frequency associated with the first channel in the first sound source file onto the first ultrasound signal to obtain the first modulated ultrasound signal at a second frequency, and wherein a frequency difference between the first frequency and the second frequency is a frequency of the first ultrasound signal.

* * * * *